United States Patent [19]

Mamberer et al.

[11] Patent Number: 4,590,856

[45] Date of Patent: May 27, 1986

[54] LIFTER-TYPE INKER FOR ROTARY PRINTING MACHINE INCLUDING ROTATIONAL SHOCK DAMPENING MEANS

[75] Inventors: Hans Mamberer, Königsbrunn; Reinhard Zeller, Augsburg; Otto Spang, Margertshausen, all of Fed. Rep. of Germany

[73] Assignee: M.A.N.-Roland Druckmaschinen Aktiengesellschaft, Offenbach am Main, Fed. Rep. of Germany

[21] Appl. No.: 674,737

[22] Filed: Nov. 26, 1984

[30] Foreign Application Priority Data

Nov. 26, 1983 [DE] Fed. Rep. of Germany ..... 3342877

[51] Int. Cl.[4] ..... B41F 31/06; B41F 31/10; B41F 31/14

[52] U.S. Cl. ..... 101/350; 101/148

[58] Field of Search ..... 101/148, 206, 207, 208, 101/209, 322, 348, 349, 350, 351, 356, 357, 358, 360, 361, 362, 363, DIG. 6

[56] References Cited

U.S. PATENT DOCUMENTS

| | | | |
|---|---|---|---|
| 2,017,139 | 10/1935 | Wood | 101/350 |
| 2,439,454 | 4/1948 | Crafts | 101/220 |
| 3,467,008 | 9/1969 | Domotor | 101/350 |
| 3,688,696 | 9/1972 | Treff | 101/350 |
| 3,814,014 | 6/1974 | Dahlgren | 101/349 |
| 4,397,236 | 8/1983 | Greiner | 101/350 |
| 4,470,347 | 9/1984 | Johne | 101/351 |

*Primary Examiner*—William Pieprz

*Attorney, Agent, or Firm*—Frishauf, Holtz, Goodman & Woodward

[57] ABSTRACT

To prevent printing of imperfect copy, by a printing machine having a lifter-type inker, which is caused by cyclically recurring rotary oscillations or vibrations, the braking torque introduced upon contact of a lifter roller (3) with the first milling and distribution roller (4) of the inker is prevented from propagating through the gearing drive of the respective inker rollers. To prevent such propagation, the first milling and distributing roller (4) is yieldingly driven at machine speed, for example by frictional drive, transmitted through an elastic surface (6) of a "soft" roller in frictional drive engagement with the first milling and distributing roller (4) as well as with a positively driven subsequent milling and distributing roller (7), or a circumferentially resilient yielding coupling (13) is interposed between the drive shaft element (8) for the first milling and distibuting roller and a positive gear drive (10, 11, 12). Preferably, the inertia of the first milling and distributing roller is high with respect to that of the lifter roller (3), and is, for example, enhanced by a fly-wheel (4*a*).

14 Claims, 2 Drawing Figures

LIFTER-TYPE INKER FOR ROTARY PRINTING MACHINE INCLUDING ROTATIONAL SHOCK DAMPENING MEANS

The present invention relates to an inker for a rotary printing machine and more particularly to an inker using a lifter-roller which transfers ink from a fountain roller carrying a metered film of ink to an inker roller train, which includes milling and distribution rollers.

BACKGROUND

Inkers usually, alternately, have rollers with hard, or unyielding, and a soft, or yielding surface. The rollers with the hard, unyielding surface may be axially oscillating, and are the distribution and milling rollers. A fountain roller, operating in an ink trough, and having a metered film of ink applied thereto by a doctor blade, is driven at a speed which is slow with respect to machine speed, which, usually, determines the circumferential speed of a plate cylinder of the printing machine. The first milling or distribution roller with which the lifter will come in contact is, usually, also positively driven at the machine speed, for example by gearing, which also drives all other rollers having hard surfaces. The gearing is, customarily, also geared to the plate cylinder.

The lifter oscillates between the fountain roller and the first milling or distribution roller, to apply the required quantity of ink from the fountain roller to the first milling or distribution roller for subsequent distribution, and further splitting of the ink film and eventual application to the printing plate of a plate cylinder. The soft surface roller which is in contact with the first milling or distribution roller usually is not driven, but carried along by circumferential or surface friction, in engagement with the first, and a subsequent, or second milling or distribution roller which, likewise, is driven. During the contact of the lifter roller with the first milling or distribution roller, the lifter roller is accelerated; upon contact with the fountain roller, which operates at a much slower speed, the lifter roller is decelerated.

It has been found that, with increasing operating speed of printing machines, or, with increasing diameter of the cylinders—which, likewise, may correspond to an increased circumferential speed of the printing cylinders, and, additionally, with increase in the width of the rollers to be able to print on wider webs or sheets, inking can become defective and the printed copy has defective points or zones, thus detracting from overall print quality. Various measures have been tried to reduce non-uniformities in printing. Pressure placed on bearer rings, and, if provided, selectively also on the bearer rings of blanket cylinders, if the printing machine is an offset printing machine, have been tried; further, adjustment in lateral register has been changed; it was believed that the reason for poor copy coming off the printing machine was due to maladjustment of bearer ring pressure, lateral register, and the like.

THE INVENTION

It is an object to improve the quality of printed copy produced by rotary printing machines.

Briefly, surprisingly, it has been found that fuzzy zones in the printed copy are caused by the inker, and more particularly by the repetitive, recurring acceleration which has to be applied to the lifter roller by the first milling and distribution roller, when the lifter roller engages the first milling or distribution roller. This recurring additional force, applied to the gearing of the first distribution roller, causes rotary oscillations to occur within the gearing drive train of the inker rollers, which rotary, or angular oscillations propagate throughout the gearing drive train to the printing cylinder. In accordance with a feature of the invention, thus, the inker is so constructed that rotary oscillations caused be engagement of the lifter roller with the first milling or distribution roller will not propagate through the gearing of the respective rollers of the inkers, and to the plate cylinder. In accordance with the feature of the invention, thus, a yielding drive connection is established between the first milling and distribution roller and the drive therefor; this yielding connection may, for example, be in form of a yielding coupling between the first milling and distribution roller and a gear train, for example by interposition of a rubbery or plastic element between the shaft and the drive gear, the plastic or rubbery element providing for resilient connection between the gear and the roller, so that any rotary oscillations of the milling and distribution roller are damped, and will not propagate through the yielding of the ink train. In accordance with another feature of the invention, the first milling or distribution roller is not positively driven, but only driven by friction, for example, via the engagement of the first milling and distribution roller with a soft-covered transfer roller which, in turn, is in engagement with a positively driven second or futher milling and distribution roller. The frictional drive, due to the engagement between the surfaces of the respective rollers, likewise, provides a yielding drive connection, particularly if the soft surface of the "soft" roller is made to dampen rotary or angular oscillations being applied thereto.

DRAWINGS

FIG. 1 is a schematic side view of a portion of an inker for a rotary printing machine, in which only those elements necessary for an understanding of the invention are shown; all other elements of the inker can be conventional; and FIG. 2 is a schematic part sectional side view illustrating a drive arrangement with a vibration, or oscillation-accepting coupling.

DETAILED DESCRIPTION

Figure 1:
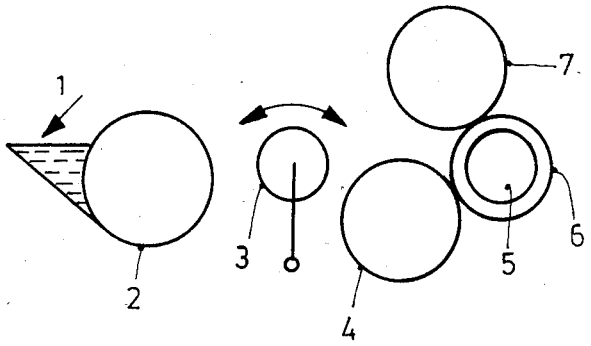

An ink trough 1, having a doctor blade, applies a metered film of ink to a fountain roller 2. The ductor roller 2 is driven at a speed which is low with respect to machine speed. A reciprocating lifter roller 3, movable back and forth as shown by the double arrow, moves between the ductor roller and a first milling and distribution roller 4. Roller 4 has a hard, ink-accepting surface. Ink, applied in strips from the fountain roller 2 by the lifter roller 3 to the first milling and distribution roller, 4 is applied to a "soft" roller 5 having a soft surface 6, the ink, then, being applied to a second milling and distribution roller 7. Further rollers of the inker roller train, alternately having soft and hard surfaces, can be coupled to the roller 7 - not shown in the drawing for simplicity. The remaining rollers of the inker can all be conventional.

In the usual structures of the prior art, the first milling and distribution roller 4, as well as the second milling and distribution roller 7, are positively coupled, for example by a gear train, to the drive system of the machine to operate in synchronism with the machine, with a linear speed corresponding to the circumferential linear speed of the plate cyclinder—not shown—of the printing machine. The intermediate "soft" roller 5 is carried along by friction.

In accordance with the invention, and entirely surprisingly, it has been found that fuzzy, or unsharp points or zones on printed copy are caused by the operating characteristics of the lifter-type inker, as described. Further investigation has shown that engagement of the lifter roller 3 with the first milling and distribution roller 4 causes, due to the required acceleration of the lifter roller, transmission of an undesired braking torque to the first roller 4. This braking torque, which occurs cyclically, is transmitted by the customary gear train in form of rotary or angular oscillations, throughout the entire inker and to the plate cylinder and, even, to the printing cylinders themselves. In accordance with the present invention, the drive for the roller 4 is so arranged that rotary or angular oscillations, that is, recurring acceleration and deceleration, are damped, so that the oscillations which might interfere with perfectly printed copy are eliminated. Surprisingly, merely changing the drive connection between the milling and distribution roller which is engaged by the lifter roller is sufficient to inhibit transfer of these rotary or angular oscillations to the inker gearing. In accordance with the feature of the invention, the drive connection between the milling and distribution roller 4 and the subsequent milling and distribution of roller 7 is, thus, no longer a positive drive, but, rather, a yielding drive which permits some variation, instantaneously, of the roller 4 with respect to the drive applied to the roller 7.

In accordance with the feature of the invention, and as a simplest solution, the yielding or elastic drive, for the milling and distribution roller 4 which is in contact with by the lifter roller 3 provides a friction drive for the roller 4 via the roller 5 which is driven in synchronism with machine speed from the second milling and distribution roller 7 of the inker roller train (not shown, and which may be entirely conventional). The rubber-like surface 6 of the roller 5 must be sufficiently elastic to provide for the frictional drive of the roller 4 while, at the same time, damping cyclical oscillations applied thereto. The elastic surface 5, suitably, is a rubber cover and, to provide for damping, it is only necessary to make the rubber layer or rubber cover 6 of the roller 5 of a sufficient thickness and having a sufficient yielding characteristic. The damping effect of a sufficiently thick rubber layer will, then, suitably suppress oscillations due to acceleration of the lift of roller 3 upon engagement with the first milling and distribution roller 4; angular or rotary oscillations, thus, will no longer be transferred through the remaining positively driven rollers of the roller train of the inker, and, specifically, will be prevented from being applied to the next milling and distribution roller 7, downstream of the roller 5.

Various other ways to inhibit transfer of rotary, or angular oscillations may be used. In accordance with another and desirable embodiment of the invention, see FIG. 2, a yielding coupling is placed in the gearing of the gear drive for the roller 4.

Figure 2:
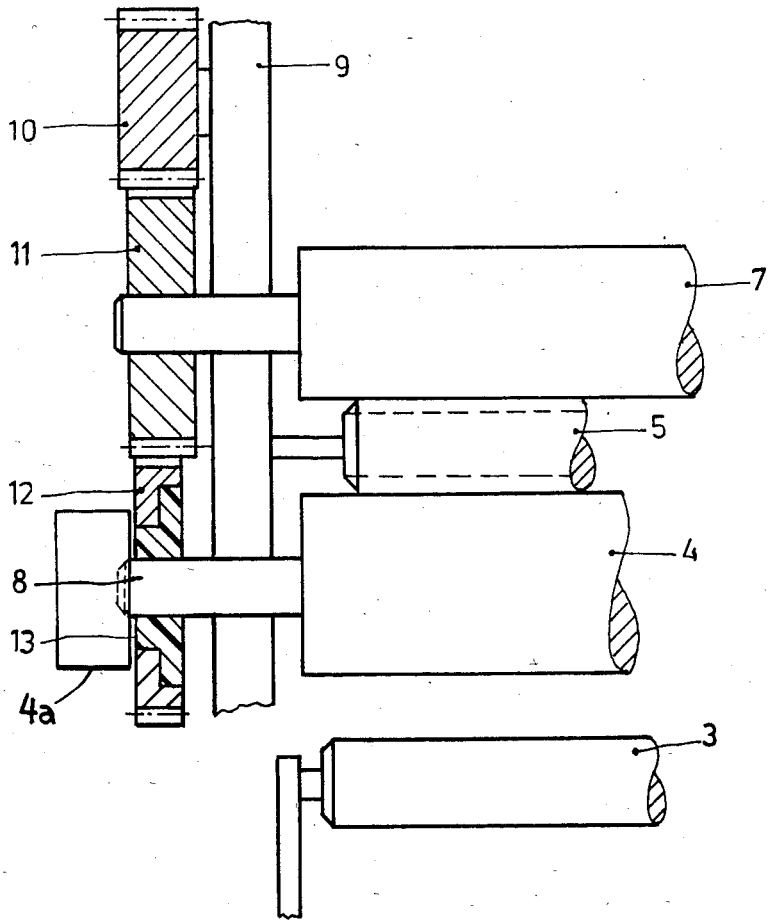

FIG. 2 illustrates, schematically, and in fragmentary form, the left half of a lifter inking system. Milling and distribution rollers 4, 7 are journalled in side walls of the inker, of which only side wall 9 is shown. The "soft" roller 5 likewise is journalled in the side wall. Gear 10, for example coupled to another "hard" milling and distribution roller, not shown, or to the drive of the printing machine, is geared to gear 11 which is splined for fixed rotary connection with the "hard" second milling and distribution roller 7. The connection between the gear 11 and roller 7 is customary, that is, the drive is positive. In accordance with the feature of the invention, the drive between a gear 12, geared to gear 11 and the first milling and distribution roller 4 is, however, via a rotary-elastic coupling 13. The rotary-elastic coupling 13 may, for example, be an elastic ring of rubber, for example hard rubber, or plastic or the like which is secured and fixed against rotation on a stub shaft 8 of the roller 4; another portion of the yielding element is fixed, against rotation, within a recess in the gear 12. The coupling 13 is yielding, rubberlike, or elastic; due to the material of the coupling 13, rotary, or angular oscillations are damped. In operation, when the lifter roller 3 engages the first milling and distribution roller 4, the lifter roller 3 is accelerated—as is well known—which causes application of a braking torque to the roller 4. This torque, which results in braking on the roller, 4 causes a decelerating force to be applied to the gearing 12, 11, 10 which, however, is damped by the rotary elastic coupling 13, so that momentary variations in torque transmission can be made uniform, damped, or evened out by the inertia of the roller 4.

If desired, further improvement is possible by so constructing the lifter roller 3 that it is of low mass and increasing the rotary inertia of the first milling and distribution roller 4, so that its inertia will be a maximum, for example by adding an additional fly-wheel **4*a* to increase the inertia of the first milling and distribution roller 4**.

Various changes and modifications may be made within the scope of the inventive concept, and features described in connection with any one of the embodiments may be used with any of the others.

We claim:

1. Lifter-type inker, for a rotary printing machine driving certain rollers therein at a machine speed, having an ink supply roller (2) rotating slowly relative to said machine speed;

a reciprocating lifter roller (3) alternately contacting said relatively slowly rotating ink supply roller (2) and a more quickly rotating first ink milling and distribution roller (4);

the first ink milling and distributing roller (4) having a hard surface;

a second ink milling and distributing roller (7) having a hard surface;

a transfer roller (5), having a soft surface (6), located between said first and second milling and distributing rollers (4, 7) and transferring ink from the first milling and distributing roller (4) to the second milling and distributing roller (7);

a drive means (10) driving said second milling and distributing roller (7) at machine speed;

a rotary-elastic coupling (13) and means for dampening rotational shock or oscillations caused by initial contact of said reciprocating lifter roller (3) with said first milling and distributing roller (4) and substantially preventing said shock from being transmitted to other rollers in said rotary printing machine, thereby causing imperfect printing, wherein said means for dampening rotational shock comprises an elastic drive connection (6, 13) comprising said soft surface of said transfer roller and said rotary-elastic coupling between the first milling and distributing roller (4) and said drive means (10).

2. Inker according to claim 1 wherein said soft surface (6) of the transfer roller (5) comprises a rubberlike surface, interposed between the first and second milling and distributing rollers (4), (7).

3. Inker according to claim 1, wherein said elastic drive connection comprises a circumferentially rubberlike element (13) secured to rotate with the first milling and distributing roller (4); and a gear (12) drivingly connected to said drive means (10) for positive drive with said drive means, said gear being coupled to said circumferentially yielding element (13) to establish a yielding, elastic coupling between the first milling and distributing roller (4) and said drive means (10).

4. Inker according to claim 3 wherein the rotary-elastic coupling comprises a ring of rubberlike material secured, respectively, to a shaft (8) extending from the first milling and distributing roller (4) and to said gear (12).

5. Inker according to claim 4 wherein the rubberlike ring comprises; plastic or hard rubber.

6. Inker according to claim 1 wherein the lifting roller (3) has a mass which is low with respect to the mass of said first milling and distributing low roller (4).

7. Inker according to claim 1 further including an inertia mass (4*a*) couple to rotate with said first milling and distributing roller.

8. Inker according to claim 7 wherein said inertia mass comprises a fly-wheel (4*a*).

9. Inker according to claim 6 further including an inertia mass (4*a*) coupled to rotate with said first milling and distributing roller.

10. Inker according to claim 9 wherein said inertia mass comprises a fly-wheel (4*a*).

11. Inker according to claim 2 further including an inertia mass (4*a*) coupled to rotate with said first milling and distributing roller.

12. Inker according to claim 11 wherein said inertia mass comprises a fly-wheel (4*a*).

13. Inker according to claim 3 further including an inertia mass (4*a*) coupled to rotate with said first milling and distributing roller.

14. Inker according to claim 13 wherein said inertia mass comprises a fly-wheel (4*a*).

* * * * *